US006513748B2

(12) United States Patent
Zeller et al.

(10) Patent No.: US 6,513,748 B2
(45) Date of Patent: Feb. 4, 2003

(54) PROCESS FOR THE OPERATION OF A BOBBIN CREEL AND BOBBIN CREEL FOR A WINDING SYSTEM

(75) Inventors: Hans-Peter Zeller, Flawil (CH); Manfred Bollen, Oberuzwil (CH); Anton Spari, Niederhelfenschwil (CH); Stefan Häne, Algetshausen (CH)

(73) Assignee: Benninger AG, Uzwil (CH)

( * ) Notice: Subject to any disclaimer, the term of this patent is extended or adjusted under 35 U.S.C. 154(b) by 0 days.

(21) Appl. No.: 09/848,276

(22) Filed: May 4, 2001

(65) Prior Publication Data

US 2001/0048045 A1 Dec. 6, 2001

(30) Foreign Application Priority Data

May 17, 2000 (EP) ..... 00810425

(51) Int. Cl.[7] ..... B65H 59/10; B65H 59/18; D02H 13/22

(52) U.S. Cl. ..... 242/419.1; 242/131.1; 242/150 R; 242/419.9; 28/194

(58) Field of Search ..... 242/419.1, 419.7, 242/419.9, 131.1, 150 R, 150 M, 154; 28/194

(56) References Cited

U.S. PATENT DOCUMENTS

| | | | | | |
|---|---|---|---|---|---|
| 3,481,011 | A | * | 12/1969 | Norton | 28/185 |
| 4,074,404 | A | * | 2/1978 | Schenk | 28/194 X |
| 4,498,644 | A | * | 2/1985 | Kupper et al. | 242/131.1 |
| 4,525,905 | A | * | 7/1985 | Bogucki-Land | 28/194 X |
| 4,538,776 | A | * | 9/1985 | Perry | 242/131 |
| 4,566,651 | A | * | 1/1986 | Kupper | 242/150 R |
| 4,646,989 | A | * | 3/1987 | Van Wilson | 242/131.1 |
| 4,664,335 | A | * | 5/1987 | Kohlen | 242/131.1 |
| 4,819,310 | A | * | 4/1989 | Beerli et al. | 28/185 |
| 4,974,301 | A | * | 12/1990 | Beerli et al. | 242/151 |
| 4,976,018 | A | * | 12/1990 | Bollen | 28/187 |
| 4,986,489 | A | * | 1/1991 | Bollen | 28/194 |
| 5,454,151 | A | | 10/1995 | Bogucki-Land et al. | |
| 5,588,194 | A | * | 12/1996 | Ulbrich et al. | 28/194 |
| 6,109,557 | A | | 8/2000 | Kremer | |

FOREIGN PATENT DOCUMENTS

| | | |
|---|---|---|
| DE | 27 35 760 | 4/1979 |
| DE | 44 18 729 | 1/1995 |
| DE | 195 46 473 | 6/1997 |
| EP | 0 012 235 | 11/1982 |
| EP | 0 319 477 | 6/1992 |

OTHER PUBLICATIONS

Zeller et al., US 2001/0045486 A1, US patent application Publication, Nov. 2001.*
International Search Report.

* cited by examiner

*Primary Examiner*—Kathy Matecki
*Assistant Examiner*—Minh-Chau Pham
(74) *Attorney, Agent, or Firm*—Shoemaker and Mattare

(57) ABSTRACT

At least one thread tension sensor for each thread is provided on a winding machine. The actual value of thread tension is measured for each thread. The actual value is compared with a specified value in a comparator device and, in the event of a deviation being determined between the actual value and the specified value, a drive motor is actuated to adjust the thread brake of the thread concerned. This arrangement allows for the maintaining of a constant thread tension by a control circuit. The thread tension sensor can be used not only to control the thread tension, but also to monitor the specified thread tension range, and as a thread break monitor.

24 Claims, 12 Drawing Sheets

2
3
4
5
6
8
9
10
11
15
L1
L2
L2
L1
RS
LS 33
34
36
5
37
9
35

PROCESS FOR THE OPERATION OF A BOBBIN CREEL AND BOBBIN CREEL FOR A WINDING SYSTEM

BACKGROUND

The invention relates to a process for the operation of a bobbin creel for a winding system. With such a process, the best possible tension compensation of all the threads on a bobbin creel is striven for, because the different running lengths of the threads between the winding heads and the winding machine and the thread guide connected to them can, without the appropriate tension compensation may lead to different thread tension values. The consequence of this would be an unequal winding density.

From EP-A 319 477 a device is known for the tension compensation of the threads on a bobbin creel, with which, by means of a common control rod, the thread brakes (yarn tensioning devices) of the vertical rows of winding heads can be subjected to different force values. The control rod is activated by drive motors, which receive actuating signals from a processor. In this situation, the actual value of the thread tension of a whole thread bundle is measured by means of a measurement roller shortly before winding. It is not possible in this situation to take account of the thread tension of individual threads or individual groups of threads.

DE-A 195 46 473 discloses a process for the control of winding devices for yarn sheets. In this case too, measurement of the tension of the thread bundle is effected shortly before winding, in order to exert an effect on the tension of the threads on the bobbin creel by way of means which are not represented in any greater detail. With the aid of a measurement carriage which is capable of being moved transversely over the thread bundle, however, the sequential tension measurement of individual threads at a predetermined time interval is possible. From this a mean tension value is formed, in accordance with which the common tension of all the threads is effected. With this process, an individual control of individual threads or individually groups of threads can hardly be achieved, because it is not possible to scan each thread simultaneously. Further disadvantages of this process are that measurement at intervals is too slow with the winding speeds used today and, in addition, the thread being measured in each case is subjected to mechanical stress by the measuring means, which has the effect of changing the individual tension of a thread.

DE-A 44 18 729 likewise relates to a device for controlling the thread tension on a bobbin creel. This device features a brake rotor for each bobbin creel directly at the winding head. A tension lever serves as the measurement sensor for the thread tension, said lever being imposed by the wound-up thread. At each bobbin holder a load-imposing device operating with fluid pressure engages on the tension lever, whereby the fluid pressure is adjustable in common for all load-imposition devices. The individual control of the thread tension can therefore be overlaid by a general adjustment capability for all thread tensioners. One disadvantage of this arrangement lies in the fact, however, that the control circuit is restricted directly to the winding head. This arrangement is not well-suited for a bobbin creel with an overhead withdrawal. In addition, braking directly at the bobbin holder is not well-suited for all work processes, and the different running lengths of the threads between the winding head and the winding machine are not taken into account.

Finally, DE-U-296 08 169 discloses a winding device for threads of bobbin creels with which a measurement device is arranged for the determination of thread tension in threads, whereby the central adjustment of preliminary twisting rails allocated to the winding heads can be controlled in accordance with the measurement result. The measuring device consists of individual pressure measuring strips, which in each case support a plurality of threads. Accordingly, monitoring of the tension in individual threads is likewise not possible, apart from the fact that the pressure measurement strips in each case can only be imposed on the outermost threads of a thread bundle.

SUMMARY OF THE INVENTION

The problem of the invention is therefore of creating a process of the type described above, which by simple means will allow for the optimum and versatile application of control of the overall winding process. In this situation, it is also intended that modern electronic means should be capable of being used, with low energy consumption. The creel control should be capable of adaptation to as many different operational conditions as possible. This problem is resolved according to the invention by a process described below.

By means of the sustained measurement of the actual value of the thread tension on each thread, the tension behavior of the threads on the entire creel can be acquired with minimal time delay. Measurement is effected in this situation in the area between leaving the creel and winding up on the winding machine, by means of which it can be assured that the different running lengths and deflections of the threads is taken into account. The control process can be designed individually for single threads or for groups of threads, as a result of which the creel can be put to versatile use. The mechanical function and arrangement of the thread brakes plays only a subordinate role in this situation. By means of this process, thread influences can be compensated for, such as different thread thicknesses, thread structure, other material influences and influences at the unwinding point in the bobbin creel.

Of particular advantage with the process according to the invention is the fact that each individual thread brake can be activated with a drive motor allocated to it. This is possible without further ado with the economically-priced miniaturized drive units available today.

It is also possible with the process according to the invention, however, for the thread brakes of each thread group with the same running length to be activated by a drive motor. As a rule, the threads from vertical rows (rails) of winding heads per bobbin side form in each case a thread group with the same running length. It is therefore possible, in an inherently known manner, for all thread brakes on a vertical row (rail) to be activated by a common drive element, whereby the drive motor is arranged in the area of the uppermost or lowest winding head. Accordingly, it is also possible for a group control to be carried out for a desired thread group, with one drive motor in each case.

In certain cases it is sufficient if the actual value is measure on at least two threads from each thread group with the same running length, and if, from the minimum of two actual values, a mean actual value is formed, which is compared with the specified value. This measuring principle is based on the assumption that the threads of a specific thread group behave in approximately the same manner. Despite the selective measurement, however, the application of the thread brakes both by means of individual drive motors on each thread brake as well as by means of a common drive motor is possible.

Further advantages according to the invention can be obtained if the threads are subjected to an additional brake force in the thread run direction before each thread brake at at least one preliminary tension device, which is set as a basic value or which is adjusted as a function of the measured actual value.

Depending on the material properties, such as quality, twist, strength, and heel inclination etc. of the threads, different preliminary tension devices must be used in order to guarantee trouble-free withdrawal of the threads. Preliminary tensioning devices on a twist basis, such as eyelet pretensioners, crepe pretensioners, etc., can be adjusted individually or rail by rail by a drive motor, in order to obtain optimum thread withdrawal.

It is also possible for the different running lengths of the threads or thread groups (creel length compensation) to be compensated for exclusively with the aid of the preliminary tension devices. In this way the downstream thread brakes will be relieved of this mandatorily required compensation task, and they can then develop their full degree of efficiency with regard to their braking force.

In addition to this, preliminary tensioning devices of the type referred to heretofore can also be used to increase the thread tension before the intake into the thread brakes, whereby the thread tension can be adjusted in common with the thread brake individually or group by group. These preliminary tensioning devices can also be used as individual means for the distribution of the tension, however. In this situation, no additional thread brakes are required, which is economically very favorable. The expression "thread brakes" as used here accordingly also encompasses all preliminary tensioning devices in the broadest sense.

In specific cases it is of advantage if, at the winding machine, the tensile force of the entire entity of the threads, combined into a yarn strip, is measured in the area in front of the winding take-up point as a strip actual value, and is compared with a strip specified value, and if, in the event of a deviation being detected, all the thread brakes are adjusted in such a way that the strip tension actual value approximates the strip specified value. This additional control of the strip tension predominates over the control of the thread tension described heretofore, whereby all changes in tension between the thread tension sensors and the winding take-up point will be taken into account.

The invention also relates to a bobbin creel for a winding system. With a bobbin creel of this nature, the thread tension is measured individually on each thread by means of thread tension sensors.

The use of at least two thread tension sensors is also conceivable, however, for the measurement of at least two threads from each group of threads of the same running length, in order to form a mean value from this.

The measurement is effected to advantage in this situation on threads which are not withdrawn from adjacent winding heads of the corresponding rails.

There are a number of fundamentally different principles of thread tension sensors known. Sensors have proved to be of particular advantage for the purpose accordingly to the invention, however, which feature a force measuring device with a measuring element imposed transversely to the thread. A thread tension sensor of this type is described, for example, in DE-A 197 16 134, the disclosure content of which is hereby adopted in full. The sensor is of compact design, with small external dimensions, and is relatively insensitive to dirt contamination. The measuring bridge, which operates on a piezo-resistive basis, requires very little energy, which plays a not inconsiderable role with the possibly large number of sensors. The measurement is also effected in directly linear fashion with the movement of the measurement sensor, as a result of which the possibility of measurement error is reduced.

The thread tension sensor can also be functionally employed in a particularly simple manner as a thread monitor for monitoring thread run or thread breakage. In the event of the thread tension of one or more threads exceeding or falling short of the lower or upper control range respectively, a warning signal is issued, or the winding system can be stopped automatically.

The functions of the thread tension sensor described can also be used, in addition to controlling the thread tension, as a monitoring function in a winding system for the entire yarn sheet.

To particular advantage, stepping motors are used as the drive motors for the thread brakes (normal pressure thread brake, such as disk brakes, twist thread brakes, dynamic thread brakes, etc.) or for the preliminary tensioning devices referred to (eyelet preliminary tensioning device, crepe preliminary tensioning device), which take effect on the braking media by means of a self-retaining gear system. The advantage of these stepping motors lies in the fact that they consume energy only during activation, but not during the stopping phase. This accordingly allows for the energy consumption to be substantially reduced. A self-locking drive motor, for example with a worm drive or a self-locking spindle drive, allows for a position to be retained which the stepping motor has moved into. The advantage of the stepping motor also lies in the fact that each time the positions of the thread brakes or the positions of the preliminary tensioning devices are known and can be calibrated.

At least one signal component can be allocated to each winding head, in particular a thread monitor for monitoring the thread run or thread break, and/or a visual signaling medium for identifying the winding heads or as a plug-on aid. Thread monitoring can be carried out in accordance with various different and inherently-known function principles, such as, for example, the mechanical drop needle principle, Hall sensors, optical monitoring devices, etc. A signal medium for facilitating the equipping of a bobbin creel is known, for example, from EP-A-329 614.

All electrically-actuatable means allocated to a winding head, in particular the drive motors for the thread brakes, but also the signal components referred to, can be activated via common signal lines. For this purpose, they are in functional connection with a central control device via serial interfaces. This evidently makes it possible for elaborate wiring of the individual components to be done away with.

BRIEF DESCRIPTION OF THE DRAWINGS

Further advantages and individual features of the invention can be derived from the following description of embodiments and from the drawings, where.

DESCRIPTION OF THE PREFERRED EMBODIMENTS

Figure 1:
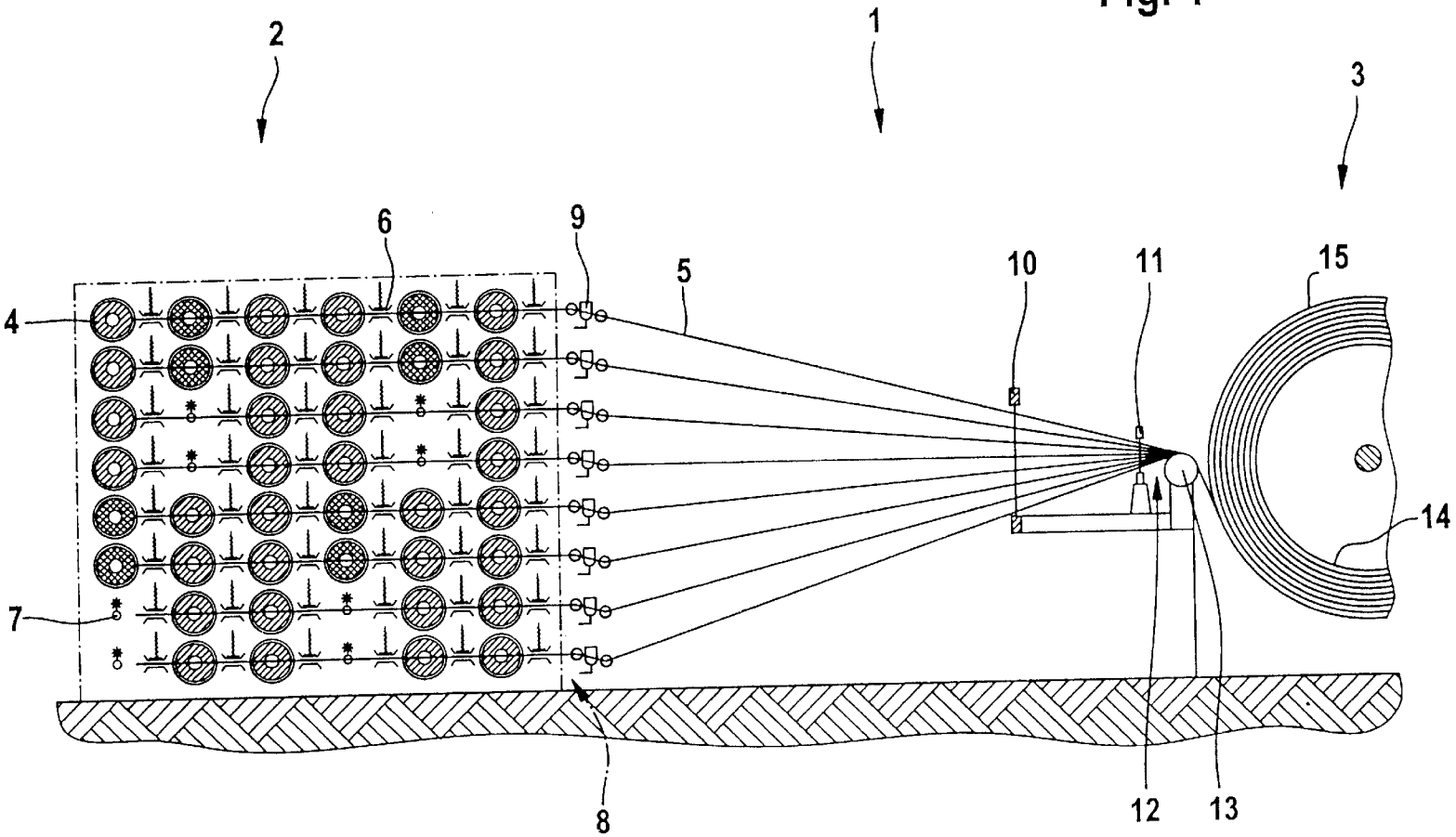
FIG. 1 is a substantially diagrammatic side view of a bobbin creel with the features of the invention.
Figure 2:
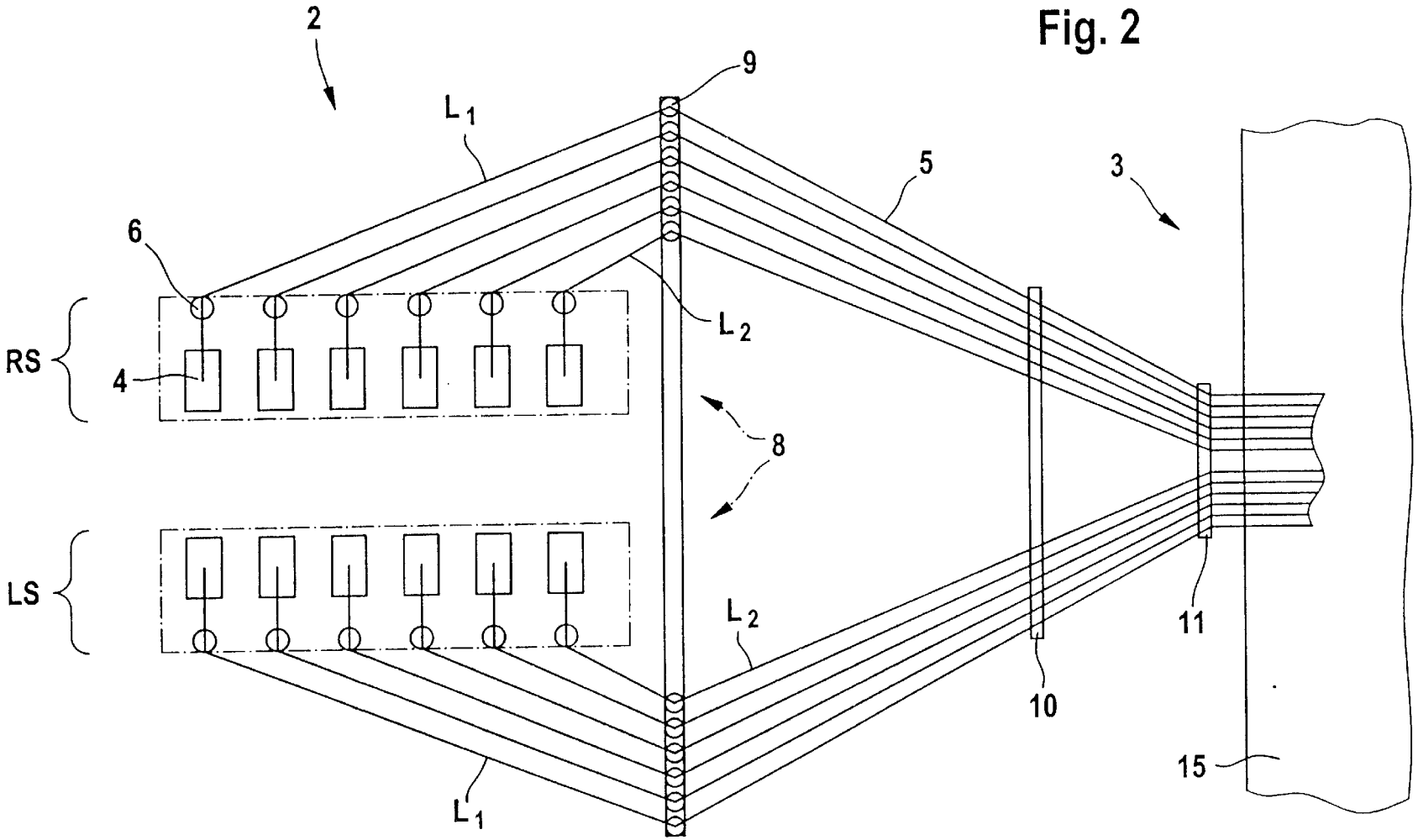
FIG. 2 is a plan view of the bobbin creel according to FIG. 1.

According to FIGS. 1 and 2, a winding system 1, such as a warping machine and creel, consists of a bobbin creel 2 and a winding machine (conical warping machine, warping machine, beaming machine, etc.) 3. The individual thread bobbins 4 are located onto winding heads 7 of the bobbin creel, and the jointly-withdrawn threads 5 pass through at least one thread brake 6 to maintain a predetermined thread tension.

The example shows a parallel bobbin creel with a left creel side LS and a right creel side RS. The bobbins in this situation form vertical and horizontal rows, whereby it can be seen that one vertical row on each creel side in each case forms a thread group, the thread running length of which, from the winding head to the winding machine, is equal. The same principle can also be applied, however, with any other creel type, e.g. in a V-creel.

Bobbins of different generic types can be fitted at different points, regardless of the thread running length, for example with different yarn qualities or different yarn colors.

FIG. 2 shows the two thread groups with the longest running length L1 and the two thread groups with the shortest running length L2.

In the area of the creel side 8 located closest to the winding machine 3 there are arranged for preference the thread tension sensors 9 for each thread. The arrangement of the thread tension sensors at this location is not mandatory, however. Basically it would be of advantage to bring the thread tension sensors as close as possible to the winding point of the winding machine.

The thread tension sensors can therefore also be arranged in an area upstream of the winding point of the winding machine, i.e. between the lease 10 and the wraithe 11 for guiding the threads together. With the corresponding miniaturization of the thread tension sensors, these can accordingly be arranged close to one another in such a way that despite the threads already having been guided together, each individual thread can still be subjected to tension. This means that even prior strip tension control would be rendered superfluous, because any changes in the braking force could be measured up to a point directly before the lapping formation.

Accordingly, the thread stretch between the bobbin creel and the winding machine can be included in the control circuit. As an alternative, however, this can also be rendered possible by the inherently-known strip tension control system being retained with a common tension measurement of the entire thread bundle shortly before winding, so that the individual control process according to the invention can still be overlaid by a global control process. A strip tension control arrangement of this nature is known, for example, from CH-A-675 598, the disclosure of which is hereby adopted in full.

After leaving the bobbin creel, the threads pass into the area of the winding machine 3, where they first pass through a lease reed 10, in which the threads are provided with their correct sequence. The threads are then guided to the wraithe 11, in which they are guided together, in order subsequently to be wound onto the roll lap 15 or the winding beam 14 as a thread bundle 12 via a guide roller and/or measuring roller 13.

Depending on the purpose of the bobbin creel, different braking media can be arranged at a winding head 7.

Figure 3:
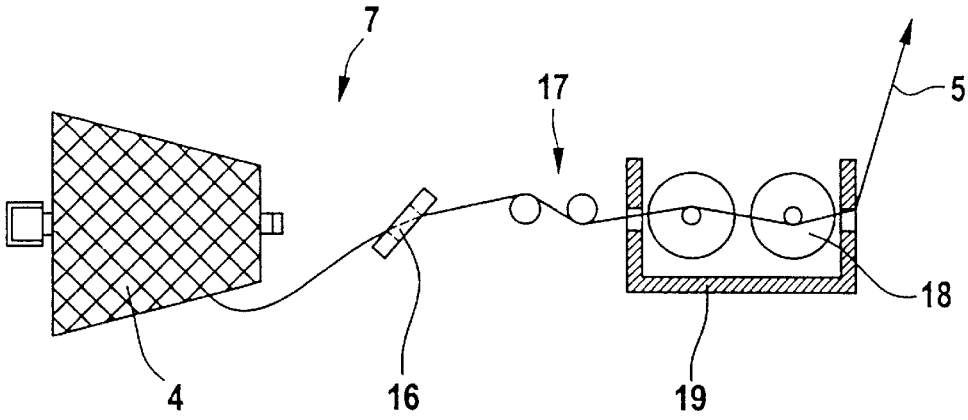
FIG. 3 is a plan view of an individual bobbin creel with preliminary tensioning devices and with a disk brake.

FIG. 3 shows, for example, how a thread 5 unwound from a bobbin 4 runs through two preliminary tensioning devices on a twist basis and runs through a thread brake. An eyelet pretensioning device 16 and a crepe pretensioning device (named after the crepe yarn, which is provided with high twist) 17 have the task, in addition to the distribution of preliminary tension, of drawing out heels formed by the thread and of functioning like a chicane to prevent a twist build-up, and so avoid the formation of heels. At the same time, they establish a limitation for the balloon of thread, which forms during unwinding from the bobbin 4.

The twisting effect of the preliminary tensioning devices 16 and 17 can be adjusted rail-by-rail or individually, e.g. by a rotational or pivoting movement. The main brake force is applied by a disk brake 18 with two brake disk units arranged behind one another in the direction of the thread run. The disk brake is located in a U-shaped vertical support profile 19, in the U-limb of which thread guide eyelets are arranged for the passage of the thread 5.

It may also be of advantage if the crepe preliminary tensioning devices are capable of individual adjustment per thread, in order to avoid heel formation with different yarn types, and therefore achieving good withdrawal behavior of the thread.

Figure 4A:
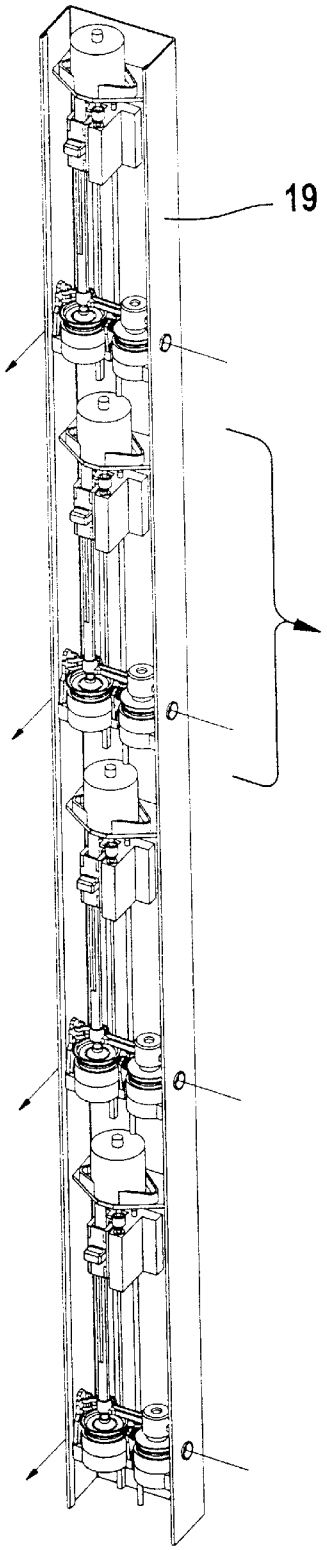
FIGS. 4*a* and 4*b* are perspective representations of a support profile with disk brakes arranged therein, in an overall view (FIG. 4*a*) and in detail (FIG. 4*b*)
Figure 4B:
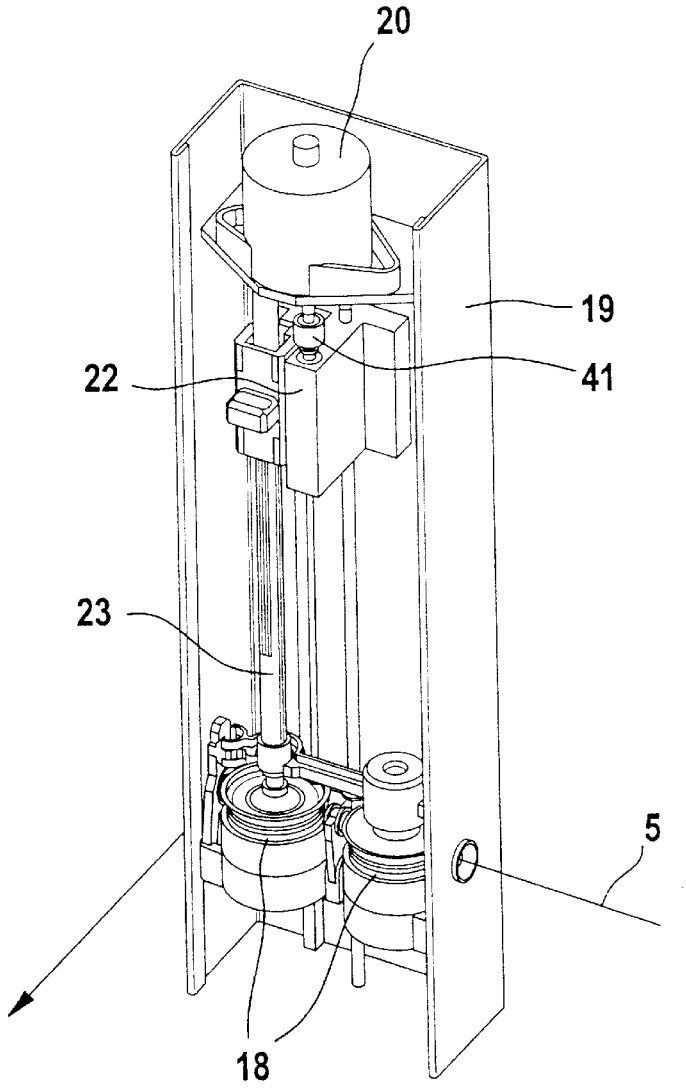

FIG. 4 shows further details of a disk brake of this type. Secured above each disk brake 18, directly in the support profile 19, is an individual drive motor 20 and a self-locking gear system 41. This actuates a pressure element 23 by means of an adjustment support 22, said pressure element applying or relieving pressure on the brake disks.

Figure 5:
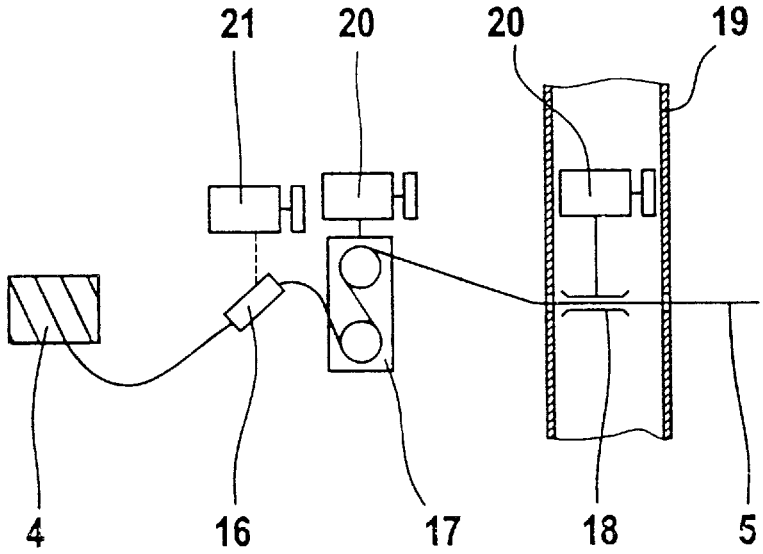
FIG. 5 is a diagrammatic side view of a winding head with an eyelet preliminary tensioning device, a crepe preliminary tensioning device, and with a disk brake.
Figure 6:
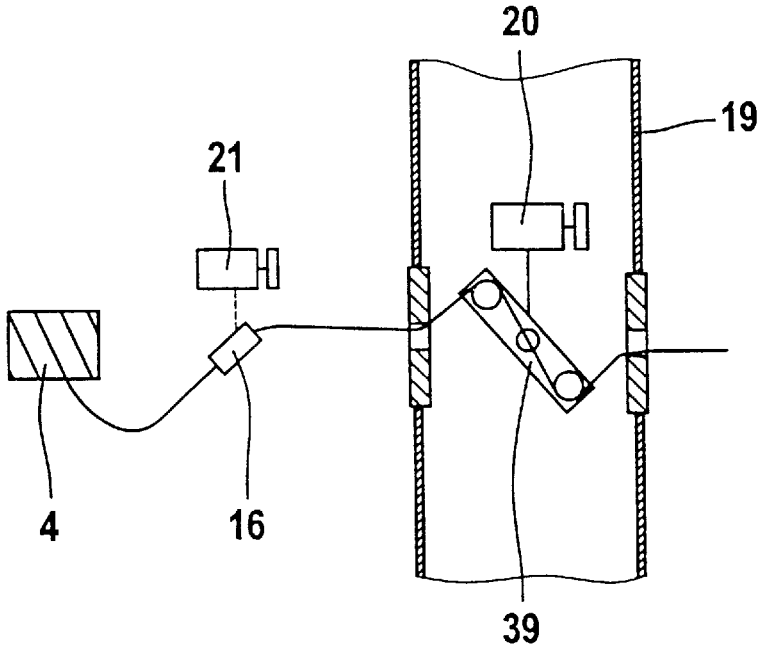
FIG. 6 is a diagrammatic side view of a winding head with an eyelet preliminary tensioning device and with a twist thread brake.

FIGS. 5 and 6 show in diagrammatic representation winding heads with different preliminary tensioning and braking devices. According to FIG. 5, the thread 5 according to FIG. 3 first runs through an eyelet pretensioning device 16 and then a crepe preliminary tensioning device 17, before it is guided through the disk brake 18.

FIG. 6 shows an alternative embodiment of a winding head with a twist thread brake 39. In this case, only one eyelet preliminary tensioning device 16 serves as the preliminary tensioning device. With the twist thread brake, the angle of rotation and therefore the degree of twist can be adjusted. This allows for the friction ratios and therefore the thread tension to be adjusted or controlled. The preliminary tensioning and brake devices according to FIGS. 5 and 6 can be adjusted rail by rail as well as individually per thread.

Figure 7:
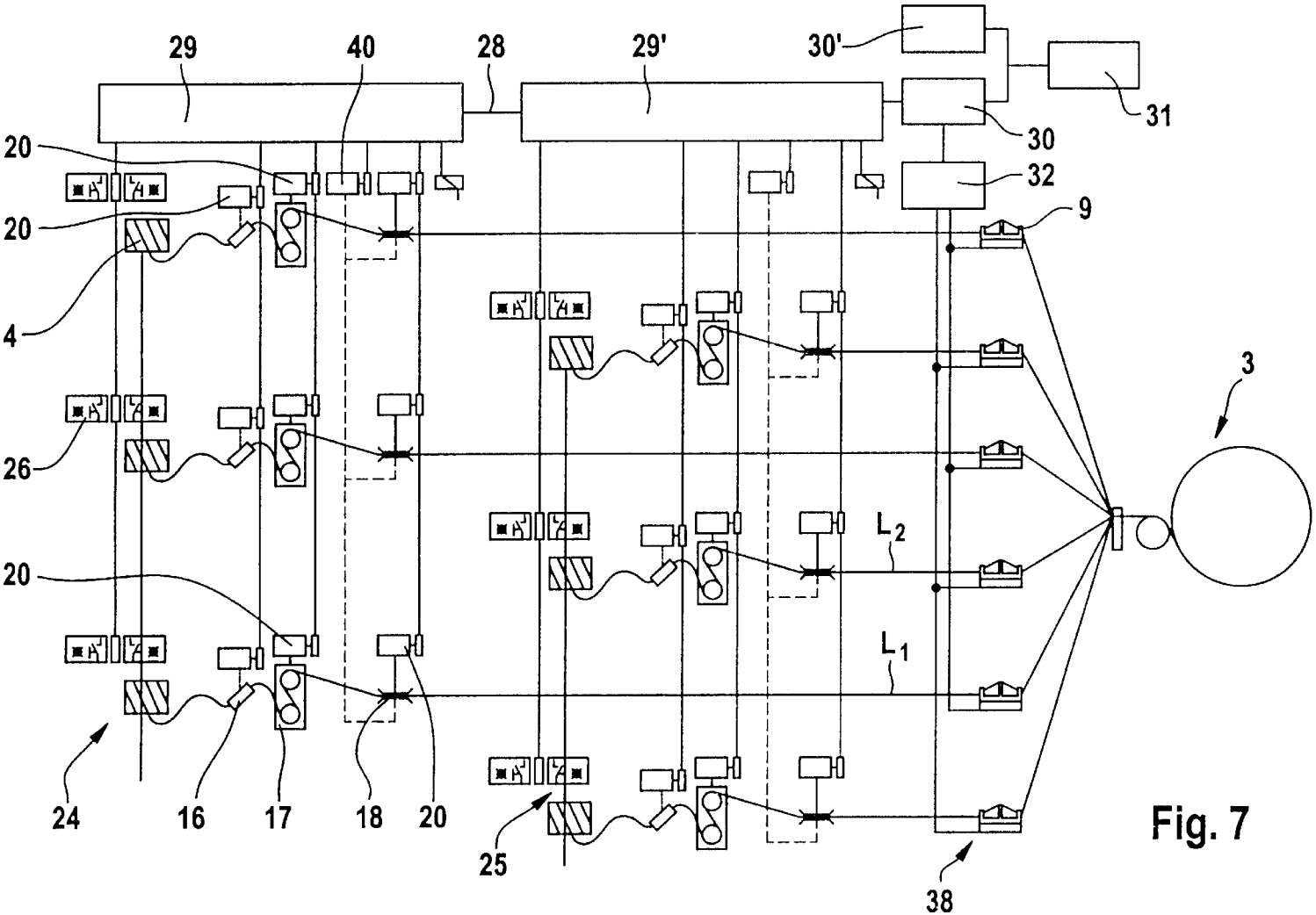
FIG. 7 is a principle representation of a bobbin creel with thread-by-thread tension measurement, individually-driven disk brakes, and individually-driven eyelet preliminary tensioning devices and crepe preliminary tensioning devices.

The principle representation according to FIG. 7 shows a row of bobbins 24, remote in relation to the winding machine 3, and a row of bobbins 25, close in relation to the winding machine, each with three stages, i.e. each with three winding heads. In reality, each vertical row (rail) may feature up to 12 stages. The thread tension is measured for all vertical rows (rails) on a common measuring plane 38.

As shown, each thread is provided with its own thread tension sensor 9.

These thread tension sensors can be used for controlling the thread tension, for monitoring the predetermined thread tension range, and as a thread break monitoring device.

Between the bobbin and the disk brake the thread runs through an eyelet pretensioning device 16 and then through a crepe pretensioning device 17. These preliminary pretensioning devices are in each case driven by an individual drive motor 20. After the pretensioning devices the threads pass to a disk brake 18, which is likewise provided with a drive motor 20. At the disk brakes of a rail, however, a common drive motor 40 can also be activated, in order to rotate the lower disk brakes in a known manner, in order to avoid the threads becoming tangled in the brake disks. It is also highly advantageous if the drive motor 40 is capable of being actuated for the disk brake drive in such a way that it can be automatically deactivated at vertical rows (rails) of winding heads without threads, on the basis of presence monitoring by the thread tension sensors or the thread monitors. It is always known, by means of the thread tension sensors or the thread monitors, which winding heads are not loaded.

In addition to this, a visual signal element 26 and an acknowledgment switch are also allocated to each winding head, which serves as a bobbin placement aid, and which therefore facilitates the fitting of the bobbin creel. The signal element serves to place the different bobbin characters or bobbin types without errors, in accordance with the specified repeats.

Each vertical row (rail) is provided with an electronic node 29, 29', which can process different signals by means of a serial line system 28. Each side of the creel is provided with its own main processor 30, 30', the activities of which can be coordinated by means of a transfer processor 31. This also allows for one side of the creel to be controlled individually. The thread tension specified values can be input rail by rail on a display unit. The specified values which are input are passed on by the transfer processor to the main processors 30 and 30' respectively, and are compared there with the actual values. The actual values for the thread tension are measured by the thread tension sensors on a common measurement plane 38 and passed on to the measurement collation units 32 and from there to the main processors 30 and 30' respectively. These main processors accordingly undertake the function of a comparator device for comparing the actual values with the input specified values.

Figure 8:
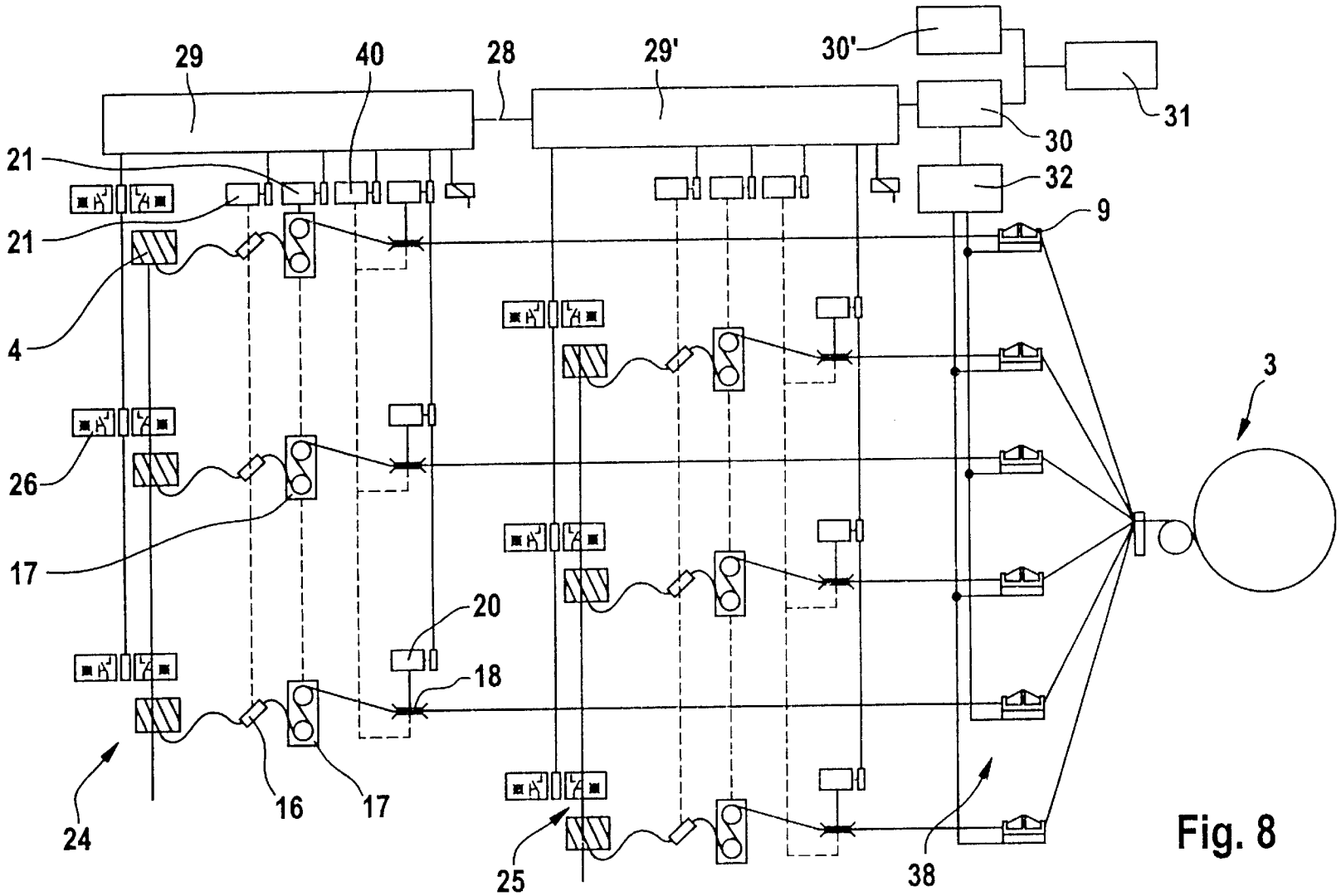
FIG. 8 is a principle representation of a bobbin creel with thread-by-thread tension measurement, individually-driven disk brakes, and eyelet preliminary tensioning devices and crepe preliminary tensioning devices driven rail by rail.

The embodiment according to FIG. 8 differs from that according to FIG. 7 inasmuch as the eyelet preliminary tensioning device 16 and the crepe preliminary tensioning device 17 are capable of adjustment rail by rail with a common drive motor 21. The disk brakes 18, however, are likewise provided with individual drive motors 20.

Figure 9:
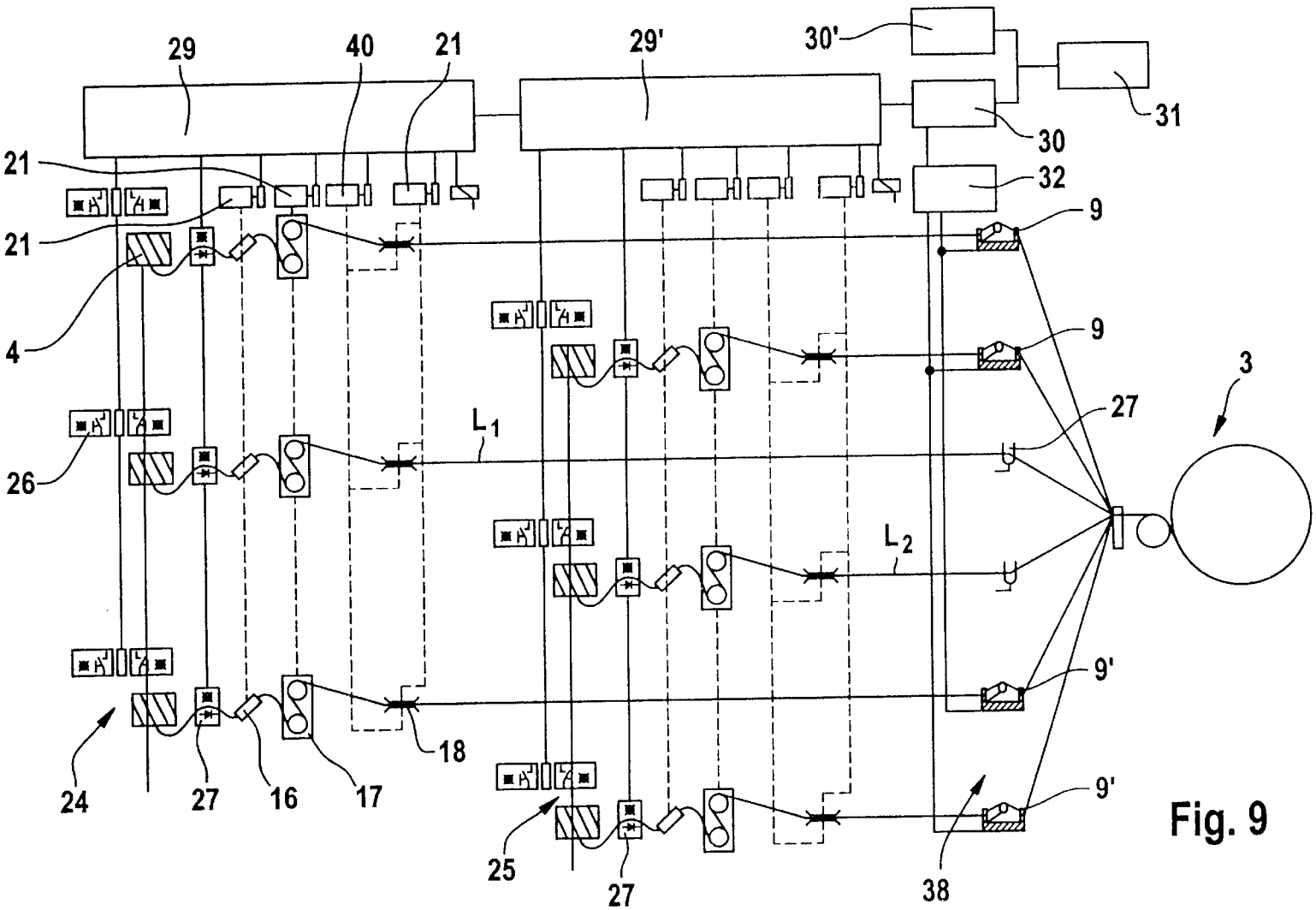
FIG. 9 is a principle representation of a bobbin creel with rail-by-rail tension measurement, disk brakes driven rail-by-rail, and eyelet pretensioning devices and crepe pretensioning devices driven rail-by-rail, and a thread monitoring device between the bobbin and the thread brake.

With the embodiment according to FIG. 9, by contrast, another measurement principle is used. As shown, not every thread has its own thread tension sensor. Only two thread tension sensors 9 and 9' are provided for per thread group L1 and L2 with equal running length in each case. It would also be conceivable, however, for more than two thread tension sensors, or even only one single thread tension sensor, to be allocated per thread group. With two or more thread tension sensors, these in each case form a mean value, which is representative for all threads of the same group, and which is conducted to the main processors 30, 30'.

Arranged on each vertical row of bobbins, in the direction of run of the thread, is a thread monitor 27, immediately after the thread bobbins 4. This is necessary with the present embodiment of the invention, because the thread tension sensors 9 do not take charge of this task for all the threads. The thread monitors could, however, also be arranged between the bobbin and the creel outlet.

As with the embodiment according to FIG. 8, in this case too the eyelet preliminary tensioning device 16 and the crepe preliminary tensioning device 17 are adjusted rail by rail by means of common drive motors 21. The drive of the disk brakes 18 is also not effected individually, however, by rail by rail by means of a common drive motor 21.

With the embodiment according to FIG. 10, once again each individual thread is provided with its own thread tension sensor 9. Instead of disk brakes, as with the preceding embodiments, however, twist thread brakes 39 are used, which are capable of being adjusted individually with an individual drive motor 20. Eyelet preliminary tensioning devices 16 serve exclusively as the preliminary tensioning devices, which are likewise adjustable by means of individual drive motors 20.

Figure 10:
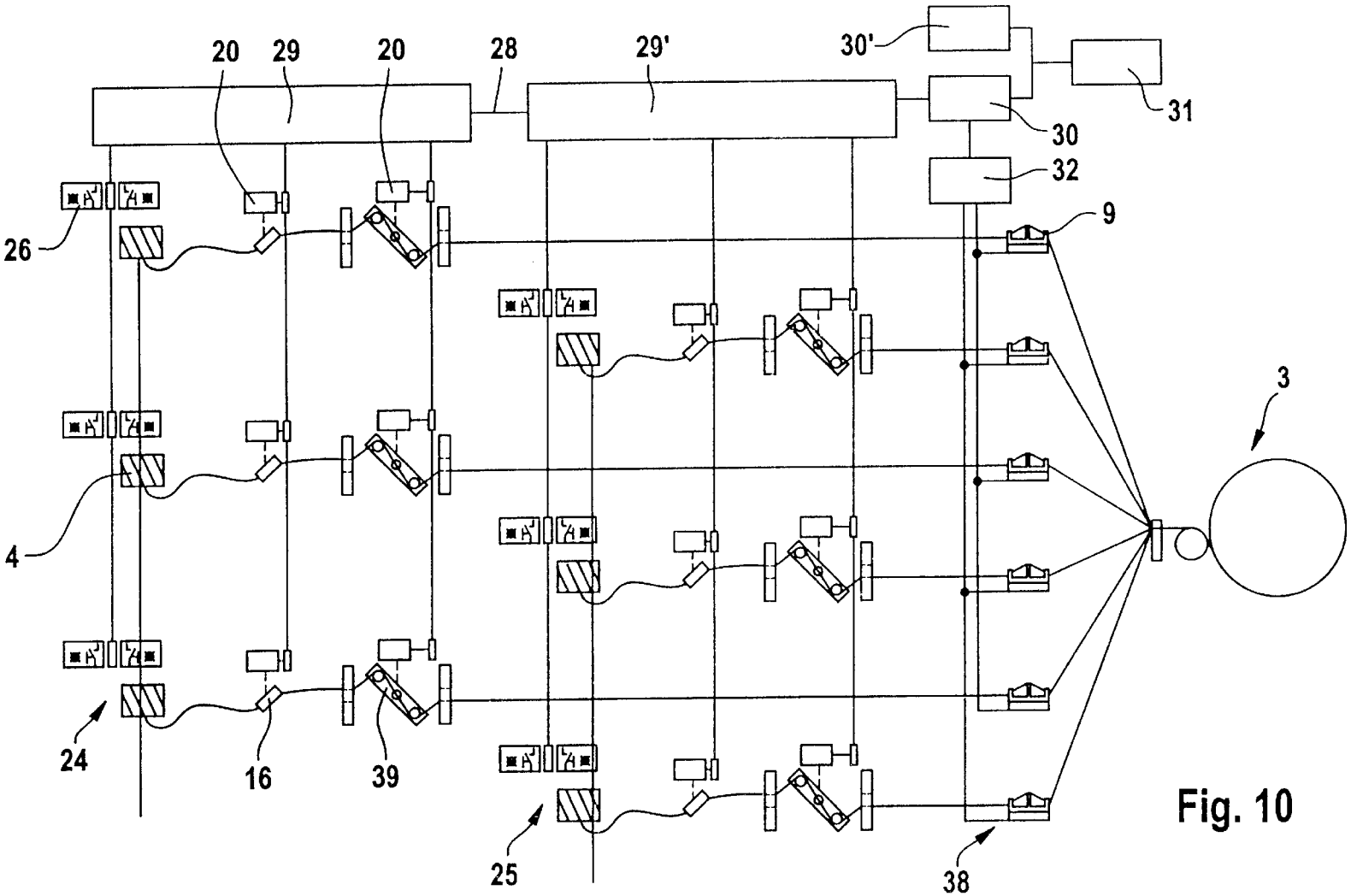
FIG. 10 is a principle representation of a bobbin creel with tension measurement thread by thread, individually-driven twist thread breaks, and individually-driven eyelet pretensioning devices.
Figure 11:
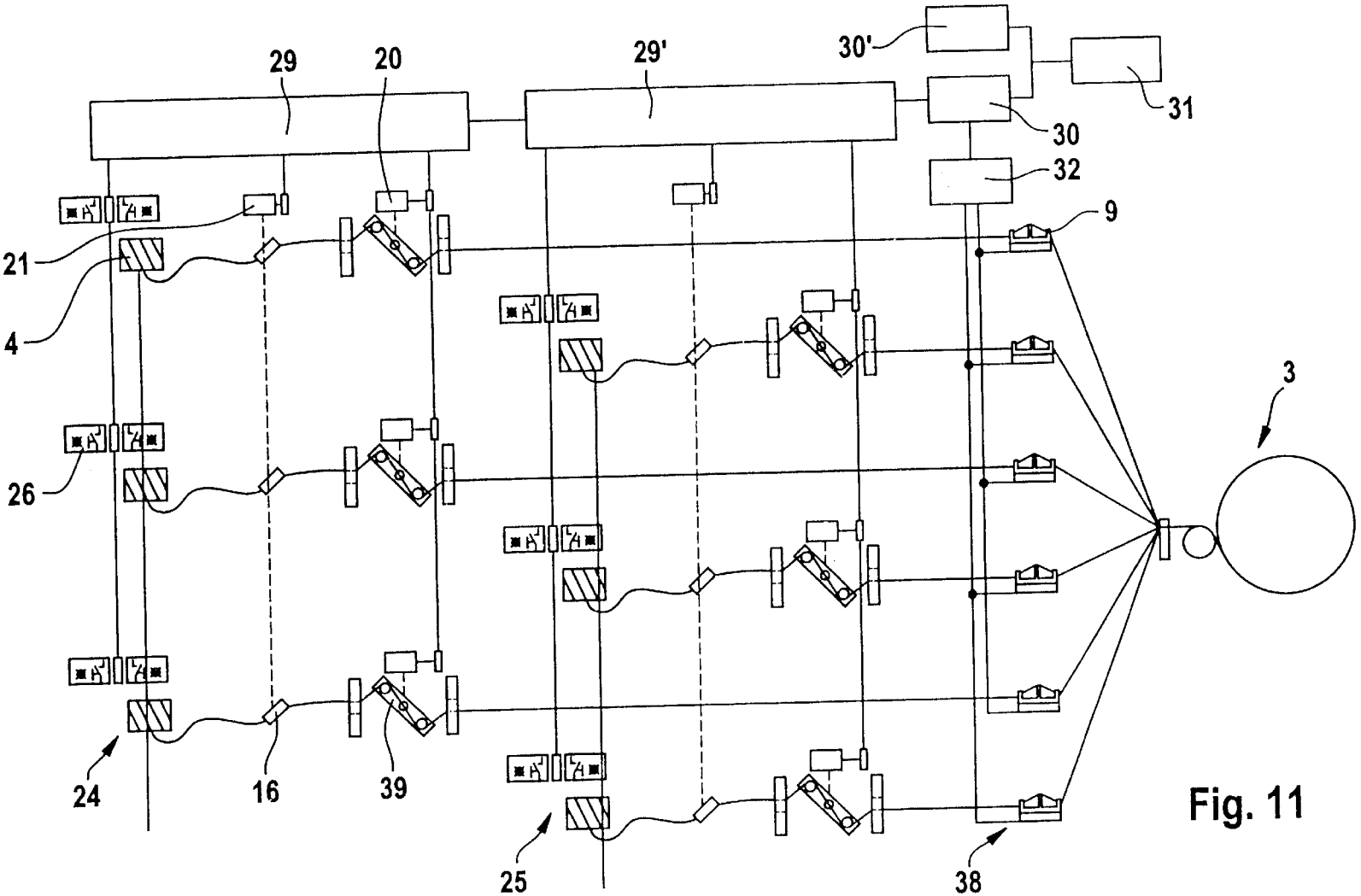
FIG. 11 is a principle representation of a bobbin creel with thread-by-thread tension measurement, individually driven twist thread brakes, and eyelet pretensioning devices driven rail by rail.

The embodiment according to FIG. 11 differs from that according to FIG. 10 only in that all the eyelet pretensioning devices 16 of a vertical row (rail) are capable of adjustment by means of a common drive motor 21.

Figure 12:
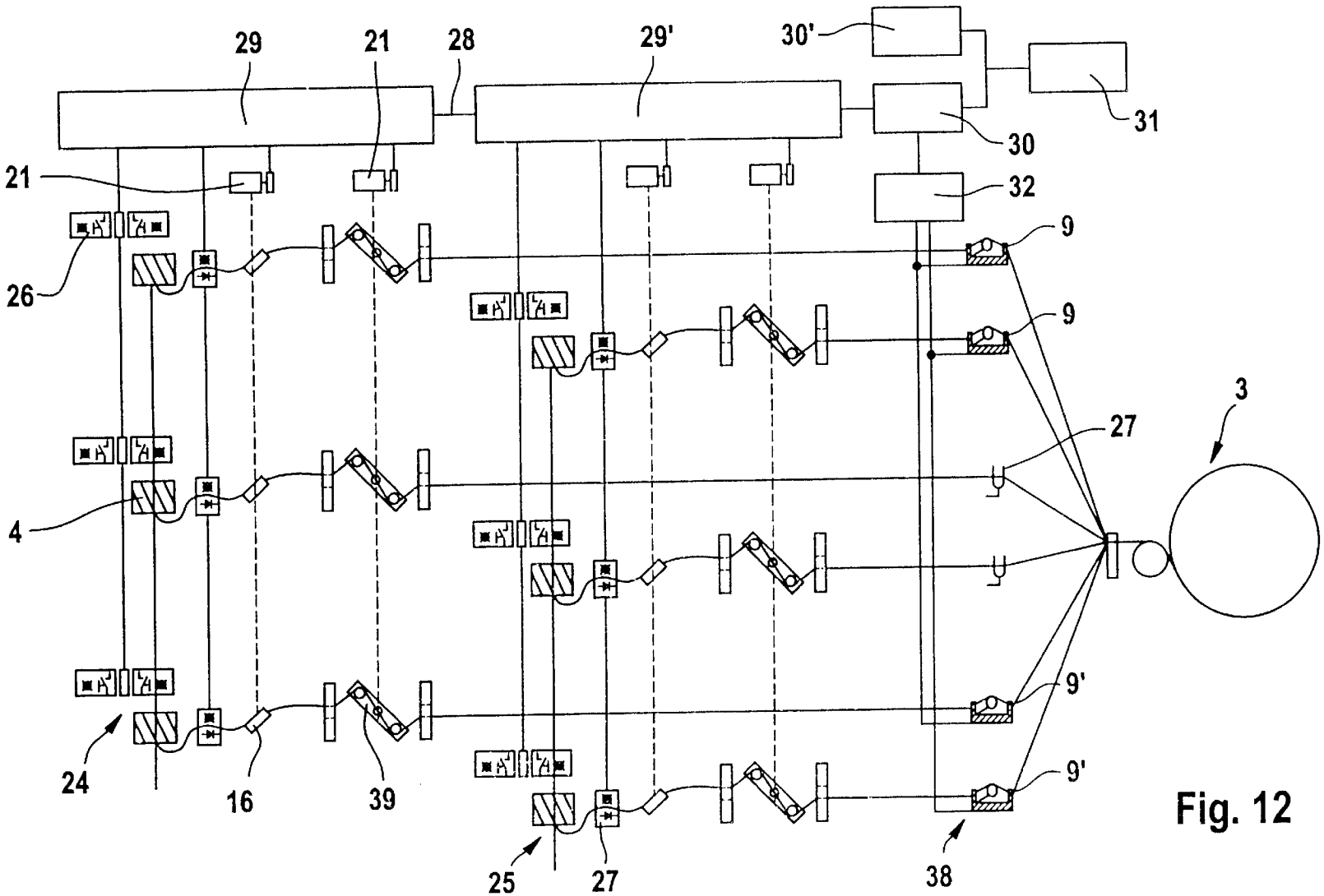
FIG. 12 is a principle representation of a bobbin creel with rail-by-rail tension measurement, disk thread brakes driven rail-by-rail, and eyelet pretensioning devices driven rail-by-rail and crepe pretensioning devices driven rail-by-rail, and a thread monitoring device between the bobbin and the thread brake.

Finally, the embodiment according to FIG. 12 in turn shows a measurement principle with which, analogously to the embodiment according to FIG. 9, the thread tension values of a thread group are determined from only two values in each case. Twist thread brakes 39 are used in this case, which are not however capable of adjustment individually but by means of a common drive motor 21. The adjustment of the eyelet preliminary tensioning device 16 is also effected rail by rail. For the thread presence check, as in FIG. 9, additional thread monitors 27 are used.

As can be seen, further combinations according to the invention are also conceivable, such as by the use of alternative thread brakes or preliminary tensioning devices or by the omission or addition of additional measuring, monitoring, or signaling devices at the individual winding heads.

Figure 13:
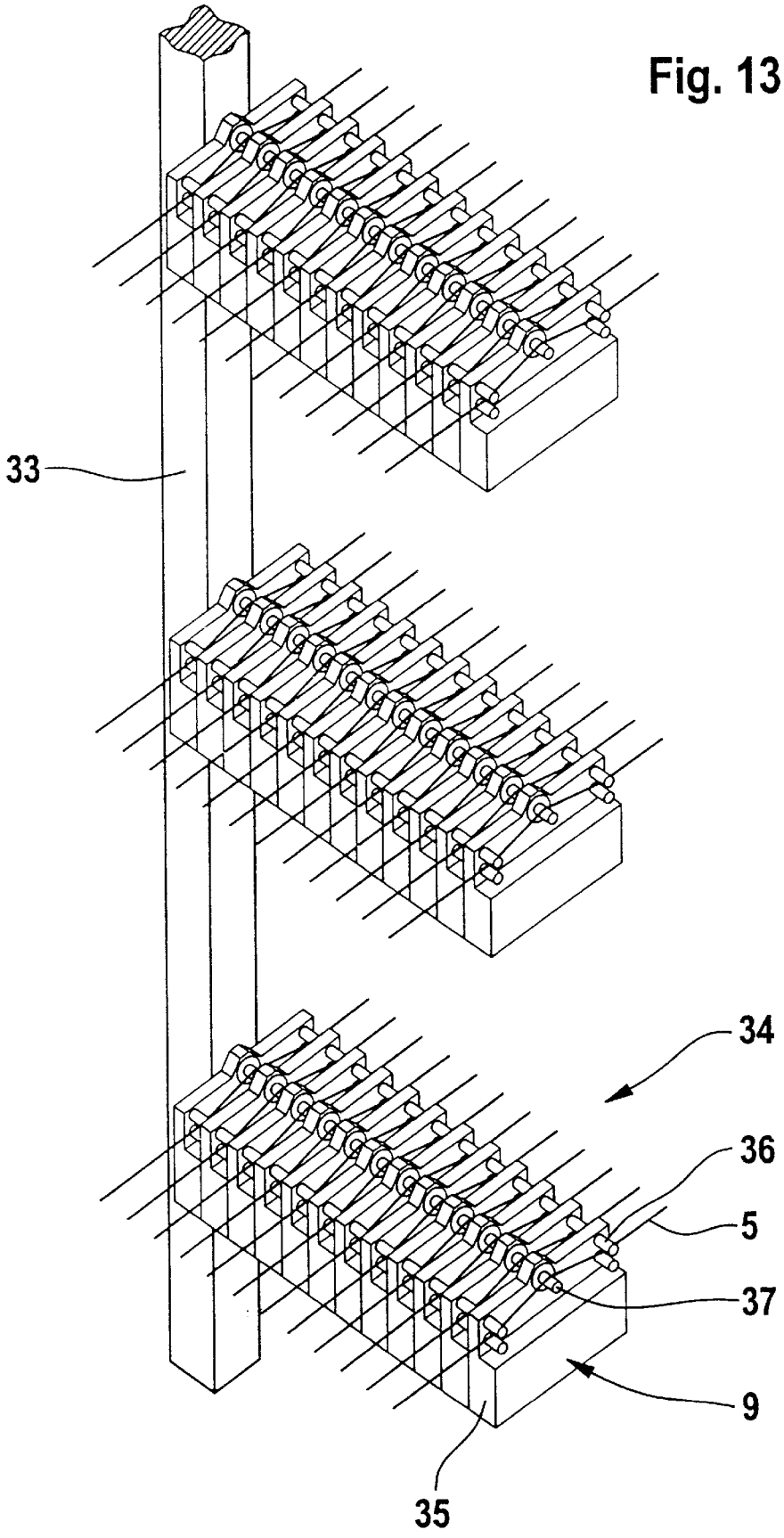
FIG. 13 is a perspective representation of groups of thread tension sensors on different levels.

FIG. 13 represents how for each stage on the creel a whole thread tension sensor battery 34 is arranged, consisting of the thread tension sensors 9. In this situation, securing is effected on a common support 33. Each sensor is provided with a movable pick-up 37, which is arranged between two thread guides 36 in such a way that the thread 5 is deflected. The actual measuring bridge is arranged in a closed housing 35, whereby the individual housings can be secured immediately next to one another.

The grouping of the thread tension sensors in units of eight elements has the advantage that these units are economical in mechanical terms, space-saving, and electrically compatible with an 8-bit unit.

What is claimed is:

1. A process for operating a bobbin creel for a winding system of a warping machine and creel having several winding heads on which several threads are withdrawn jointly by a winding machine from the winding heads, in which at each winding head, as a function of the running length between the winding head and the winding machine, the thread is subjected to a braking force at at least one thread brake, and several threads of the same running length form at least one thread group, wherein:

at least at one thread from each thread group with the same running length, an actual value of the thread tension is measured in an area between leaving the creel and winding up on the winding machine;

the actual value measured is compared with a specified value; and, in the event of a deviation being determined between the actual value and the specified value, the thread brakes of the group of threads concerned are adjusted in such a way that the actual value approximates the specified value, whereby the thread tension measurement is always effected on individual threads.

2. A process according to claim 1, wherein the thread brakes of each thread group with the same running length are activated by a common drive motor.

3. A process according to claim 1, wherein the thread brakes of each thread group with the same running length are activated by a drive motor allocated to each thread brake.

4. A process according to claim 1, wherein, from each thread group with the same running length, the actual value of the thread tension is measured at at least two threads, and from the minimum of two actual values, an actual mean value is formed, which is compared with the specified value.

5. A process according to claim 1, wherein the threads are subjected to an additional braking force before each thread brake, at at least one preliminary tensioning device, which is adjusted as a function of the actual value measured, or being permanently set as a basic value.

6. A process according to claim 1, wherein at the winding machine the tension of all of the threads, combined to form a thread strip, is measured in an area before the winding point, as a strip tension actual value, and is compared with a strip specified value, and, in the event of a deviation being detected, all the thread brakes are adjusted simultaneously in such a way that the strip actual value approximates the strip tension specified value.

7. A bobbin creel for a winding system of a warping machine and creel, with several winding heads from which several threads are drawn off simultaneously by a winding machine, and with at least one thread brake allocated to each winding head, at which the thread is subjected to a braking force as a function of the running length between the winding head and the winding machine, wherein the threads of equal running length form at least one thread group, wherein in an area between the winding heads located closest to the winding machine on one creel side and a winding beam of the winding machine, a thread tension sensor is arranged for each thread group with the same running length, at which the actual value of the thread tension of an individual thread is measured;

the actual value being compared in a comparator device with a specified value; and, in the event of a deviation being determined between the actual value and the specified value, a drive motor is activated, to adjust the thread brake of the group of threads concerned in such a way that the actual value approximates the specified value.

8. A bobbin creel according to claim 7, wherein the thread brakes of a vertical row of winding heads are activated by a common drive motor.

9. A bobbin creel according to claim 7, wherein each thread brake is activated by a drive motor allocated to it.

10. A bobbin creel according to claim 7, wherein at least two thread tension sensors are allocated to each vertical row of winding heads, with which the thread tension of two threads of the row concerned are measured individually, and an actual mean value is formed in a computer from the measured actual values, which is compared with the specified value.

11. A bobbin creel according to claim 7, wherein an individual thread tension sensor is allocated to each winding head.

12. A bobbin creel according to claim 7, wherein the thread tension sensors feature a force measuring device with a measuring element capable of being actuated on expansion, whereby the force occurring transversely to the thread may be measured on a deflected thread.

13. A bobbin creel according to claim 7, wherein per creel stage, several thread tension sensors are arranged in a row, and each sensor is surrounded by a separate housing.

14. A bobbin creel according to claim 7, wherein at least one pretensioning device is allocated to each winding head, arranged in the direction of the thread run upstream of the thread brake, for the application of an additional braking force, said pretensioning device being driven independently of the thread brake, or permanently set as a basic setting.

15. A bobbin creel according to claim 14, wherein the preliminary tensioning device is an eyelet pretensioning device with a rotatable eyelet, deflecting the thread, or a crepe pretensioning device with adjustable twist elements.

16. A bobbin creel according to claim 15, wherein the preliminary tensioning device has at least one crepe pretensioning device, which is individually adjustable by means of a drive motor allocated to it.

17. A bobbin creel according to claim 14, wherein the at least one preliminary tensioning device of a vertical row of winding heads are adjusted by a common drive motor, and the thread brakes of the same row are activated either by means of a common drive motor or by drive motors allocated to each thread brake.

18. A bobbin creel according to claim 7, wherein the thread brakes are twist brakes with adjustable twist angles or disk brakes with the brake disks taking effect on the threads and capable of being subjected to differing loads.

19. A bobbin creel according to claim 18, wherein the brake disks for the thread brakes of a vertical row are rotated by a common drive motor which may be actuated in such a manner that, by means of the thread tension sensors or thread monitors, the drive motor of the vertical row concerned is automatically deactivated if thread is absent.

20. A bobbin creel according to claim 7, wherein the drive motors for the thread brakes are stepping motors which take effect on the thread brakes by means of a self-locking gear system.

21. A bobbin creel according to claim 7, wherein at least one thread monitor for thread brake monitoring or movement monitoring of the thread is allocated to each winding head.

22. A bobbin creel according to claim 7, wherein at least one visual signalling device is allocated to each winding head, for identifying the winding head or as a bobbin positioning aid.

23. A bobbin creel according to claim 7, wherein all electrically actuatable media allocated to a winding head, including the drive motors for the thread brakes, are in operational connection with a central control device by means of serial interfaces.

24. A bobbin creel according to claim 7, wherein the thread tension sensors are arranged in an area before the winding take-up point of the winding machine and between a lease and wraithe for guiding the threads together.

* * * * *